US005771034A

United States Patent [19]

Gibson

[11] Patent Number: 5,771,034

[45] Date of Patent: Jun. 23, 1998

[54] FONT FORMAT

[75] Inventor: Michael Scott Gibson, Redmond, Wash.

[73] Assignee: Microsoft Corporation, Redmond, Wash.

[21] Appl. No.: 851,410

[22] Filed: May 5, 1997

Related U.S. Application Data

[63] Continuation of Ser. No. 376,744, Jan. 23, 1995, abandoned.

[51] Int. Cl.[6] ..... G09G 5/22

[52] U.S. Cl. ..... 345/141; 345/192

[58] Field of Search ..... 345/114, 141, 345/143, 144, 136, 192, 194, 195, 128, 153

[56] References Cited

U.S. PATENT DOCUMENTS

| | | | |
|---|---|---|---|
| 4,594,674 | 6/1986 | Boulia et al. | 364/523 |
| 4,622,546 | 11/1986 | Sfarti et al. | 345/192 |
| 4,881,069 | 11/1989 | Kameda et al. | 345/128 |
| 4,908,780 | 3/1990 | Priem et al. | 345/114 |
| 4,998,210 | 3/1991 | Kadono et al. | 364/518 |
| 5,021,974 | 6/1991 | Pisculli et al. | 364/518 |
| 5,040,130 | 8/1991 | Chang et al. | 345/136 |
| 5,099,435 | 3/1992 | Collins et al. | 395/150 |
| 5,175,811 | 12/1992 | Sone et al. | 345/194 |
| 5,280,577 | 1/1994 | Trevett et al. | 395/150 |
| 5,300,946 | 4/1994 | Patrick | 345/153 |
| 5,533,180 | 7/1996 | Zhou et al. | 395/150 |
| 5,583,978 | 12/1996 | Collins et al. | 395/170 |

*Primary Examiner*—Xiao Wu
*Attorney, Agent, or Firm*—Jones & Askew

[57] ABSTRACT

An improved font format for displaying text-based characters on pixel-oriented display devices. The improved font format includes a simplified header that includes font information and a plurality of flags indicating one of a plurality of predetermined formats for the plurality of glyph bitmaps. The header also includes a flag indicating whether the font was derived from a bitmapped font and a flag indicating whether the font is stored as a small format (i.e., less than 64k) or a large format (i.e., greater than 64k). A movable glyph offset table and a movable advance width table are also provided. To facilitate antialiased textout, additional background mode values are provided to allow for a blending of the glyphs into the background.

20 Claims, 3 Drawing Sheets

FONT FORMAT

This is a continuation of application Ser. No. 08/376,744 filed Jan. 23, 1995, now abandoned.

TECHNICAL FIELD

This invention relates generally to the display of fonts, and in particular to an improved font format for rendering a character bitmap on pixel-oriented display devices.

BACKGROUND OF THE INVENTION

Most general purpose computer systems support the display of text-based characters, including letters, numerals, and other symbols, on pixel-oriented display devices. A "pixel" is the smallest element that display or print hardware and software can manipulate in rendering letters, numbers or graphics. Although pixels are typically square or round in shape for most devices, many newer pixel-oriented display devices include rectangular pixels. The display surface for a pixel-oriented display device consists of a grid of points, or pixels, each of which can be individually illuminated or "darkened" to display an image. A pixel is activated or "turned on" when the process that generates the display determines it is appropriate to activate that portion of the image field.

In general, to display text on a pixel-oriented display device, a computer system accepts one or more "fonts". A "font" is a collection of characters of a particular typeface and a particular size. Fonts are typically created by typographers, who design a character outline or "glyph" of each character for a particular font, including characters, numbers, punctuation symbols, and any other image for a given font. Each outline is comprised of a combination of straight lines and curves that form the shape of the character's outline. This glyph or outline description of the character is typically stored within a font file maintained by the computer system in either volatile or nonvolatile memory.

A glyph for a given character in a font is described as a numbered sequence of points that are on or off a curve defining the boundary of the character. In general, the number sequence for the points should follow a recognized rule for how the points relate to the area to be filled and the area not to be filled when rendering the glyph. For True Type font descriptions, which are defined within the True Type software program marketed by Microsoft Corporation in Redmond, Wash., the assignee of the present invention, the points are numbered in consecutive order so that as a path is traversed in the order of increasing point numbers, the filled area will always be to the right of the path.

In order to render a font on a selected display device, the outline supplied by the font file is scaled according to the font size requested by the user and the characteristics of the display device on which it is to be displayed, i.e., its resolution. Fonts may be displayed on a wide variety of output devices, including raster scan cathode ray tube (CRT) displays, pixel-oriented LCD displays, dot matrix printers and laser printing devices. The resolution of a pixel-oriented display device is specified by the number of dots or pixels (dpi) that are to be displayed. For example, a Video Graphics Adapter (VGA) under OS/2 and "WINDOWS" operating systems is treated as a 96 dpi device, and many laser printers have a resolution of 300 dpi. Some devices, such as Enhanced Graphics Adapter (EGA), have different resolution in the horizontal and vertical directions (i.e., non-square pixels). In the case of the EGA, this resolution is 96×72 dpi.

The outline description of a character may also contain hints, which are routines that, when executed, adjust the shapes of the character outlines for various point sizes to improve their appearance. Thereafter, the outline is scan converted to produce a character bitmap that can be rendered on the selected display device.

A character bitmap, also referred to as a glyph bitmap, represents a grid-like array of pixels and each array element contains a pixel center. The pixel centers are connected in either horizontal or vertical directions by straight lines commonly described as scan lines or reference lines. Each character bitmap contains data reflecting which pixels in a subset of the display grid must be illuminated in order to form an image of a particular character. Each pixel in the image corresponds to one or more bits in the character bitmap. Monochrome bitmaps require only one bit per pixel; color bitmaps require additional bits to indicate the color of each pixel.

When a computer system needs to display a particular character at a display location, it accesses the character bitmap for that character. The computer system then turns the illumination of pixels near the display location on or off in accordance with the data stored in the character bitmap. The concept of displaying a character extends to a temporary display, such as a CRT display, as well as a more permanent image creation in the form of a printer.

Using font descriptions, computer systems can now dynamically create character bitmaps defining the images to be displayed, also described as "bitmapped fonts". A computer program, which is also described as a rasterizer program, is typically incorporated as part of an operating system or printer control software program to provide this font technology service. The rasterizer program may be called by an application program, such as a word processor or a spreadsheet, when the program requires a bitmapped font. In response to this request, the rasterizer program reads a description of the character outline from a font file stored within a memory storage device.

The rasterizer program also receives the character's height or "point" size and the predetermined resolution of the intended display device to support the scaling of the character outline. This information supports a mapping of the description of the character outline into physical pixel units for the display device to be employed in displaying the character in that particular size. Thus, the geometric description of the character outline is scaled in physical pixel coordinates and represents a function of the predetermined physical pixel size of the display device and the requested point size. This process alters the height and width of the character.

If required, the rasterizer program applies hints to the scaled character outline to fit it in pixel boundaries while distorting the scaled outline as little as possible. The rasterizer program thereafter conducts a scan conversion operation for the hinted character outline by superimposing a grid corresponding to the horizontal and vertical densities of the intended display device over the hinted outlines, then designating the subset of pixels of the grid whose centers fall within the hinted outlines as pixels requiring illumination by the display device. The rasterizer program then returns the resulting bitmapped font to the application program, which may use it to display text. The bitmapped font may also be stored within an allocated buffer of computer system memory or display device memory to be used to satisfy the identical request received in the future.

One of the primary advantages of using character bitmaps to store graphical information is the extraordinary speed at which bitmaps can be copied to a video display. Character bitmaps, however, require a large amount of storage space. For example, a bitmap representation of an entire 640-by-480-pixel, 16-color VGA display screen requires over 150 KB of storage space. The actual amount of storage space required to store a bitmap is determined by the size of the image and the number of colors that it contains.

Fonts can be stored in a variety of data structures, also referred to as records or formats, which are organizational schemes applied to data so that it can be interpreted and so that specific operations can be performed on that data. One of the most widely utilized font formats today is the FONTINFO data structure for the "WINDOWS" operating system, developed by Microsoft Corporation. The FONTINFO data structure, which is described in detail on pages 475–484 of the "Device Driver Adaptation Guide" for the "WINDOWS" operating system, was originally designed to allow unaccelerated EGA and VGA adapters to simultaneously draw the text and the text background when rendering characters onto a pixel-oriented display device.

Since the development of the FONTINFO data structure, however, there have been many advancements in font technology that have rendered the font format unsuitable for many applications. Modem hardware and device drivers, for example, now use accelerators to rapidly draw the rectangles such as the text background. The text can then be drawn on top of the text background. The current FONTINFO data structure, however, is not designed to utilize this capability and thus suffers from several limitations.

First, in light of the advancements in font technology, the FONTINFO data structure is unnecessarily complex. For example, the FONTINFO data structure includes global information about the physical font, such as the font type, point size, and whether the character is underlined or italicized. Most of this information is to allow the device driver to implement the font itself. In an effort to simplify the design of device drivers, however, these simulation functions are now typically performed by the operating system. Thus, much of the information contained in the FONTINFO data structure is not even used by modem device drivers and is therefore unnecessary.

Furthermore, because the FONTINFO data structure is not designed to take advantage of the capabilities of modem accelerators, many device drivers are forced to convert the character bitmaps into their own custom format and store that in a memory storage area associated with the device driver, typically on a video card. While this approach improves the overall speed at which text can be rendered on a display device, it requires that the device drivers be unnecessarily complex, increasing the likelihood of coding or logic errors in the software. Furthermore, it consumes a significant amount of memory on the video card that would be better utilized caching things other than fonts.

Another limitation of the conventional font format is that the entire "bounding box" is bitmapped, including the blank space above and below the actual character that is used to position the character vertically. The bounding box is the rectangular boundary that encloses the character that is to be displayed. Because of the advancements in font technology, however, only the bitmaps of the character itself, sometimes referred to as the "black box", is actually required to render the character. As discussed above, character bitmaps require a large amount of storage space. Thus, the current FONTINFO data structure, by storing the bitmaps of the entire bounding box, consumes an enormous amount of unnecessary storage space.

Yet another limitation of the current FONTINFO data structure is that it is primarily designed to accommodate the 8-bit ANSI character set. The ANSI character set only defines 256 values, which is insufficient for some foreign languages, such as Korean or Chinese, which can have up to 10,000 characters in their fonts.

Other limitations of the current FONTINFO data structure relate to its character offset table. Depending on whether the font is realized by the operating system or by a device driver, the FONTINFO data structure may be immediately followed by a character offset table and by font bitmap or vector information. The character offset table specifies the width of each character as well as the offset to the corresponding bitmap or vector information. A significant limitation of the character offset table in the old font format is that its location is fixed, meaning that it is not possible to point it to another location. Furthermore, the array of character offset data structures in the character offset table is indexed in an awkward manner, namely by subtracting the first character from the character code to produce an index into the array of character offsets. The problem with this is that the array is 6-bytes long, which is difficult to index on a 80386 or 80486-based computer system.

Thus, there is a need for an improved font format that is compatible with the requirements of modern accelerators and device drivers.

There is also a need for an improved font format that only passes the bitmaps of the character that is to be rendered, and not the entire bounding box.

There is also a need for an improved font format that is not language dependent and that can accommodate any character set, regardless of the number of characters in its fonts.

There is also a need for an improved font format that is not limited by a fixed character offset table.

SUMMARY OF THE INVENTION

As will be seen, the foregoing invention satisfies the foregoing needs. Briefly described, the present invention provides an improved font format that is better suited for the display of text-based characters on display devices than conventional font formats. The preferred font format is designed to pass only the bitmaps of the character itself rather than the surrounding white space as well, which consumes less storage space and allows for faster performance than conventional font formats. Only the information needed to locate the glyph bitmaps and do font caching in the device driver is included in the font format, which represents a significant simplification over the current FONTINFO data structure.

More particularly described, the present invention provides a method and system for displaying a plurality of characters of a font on a pixel-oriented display device, in which the font is stored in an improved font format within memory of a computer system. The improved font format includes a simplified header that includes font information, such as the height and ascent of the font, the number of characters in the font, and a unique identification value for the font. The header also includes a plurality of flags indicating one of a plurality of predetermined formats for the plurality of glyph bitmaps. In particular, the flags indicate whether the font is stored as a byte-packed glyph format or as a bit-packed glyph format.

The header of the improved font format also includes a flag indicating whether the font was derived from a bitmapped font and a flag indicating whether the font is stored as a small format (i.e., less than 64 k) or a large format (i.e., greater than 64 k).

The improved font format also includes a movable "glyph offset table", which is an offset to an array of pointers to glyph bitmaps associated with the plurality of characters in the font. A movable "advance width table" is also provided, which is an offset to an array of values that specify the distance from one glyph's origin to the next. Following the advance width table are the bitmaps for each of the glyphs in the font. Each glyph bitmap corresponds to physical pixels that form an image of the character on the display device.

In order to display text-based characters onto a display device, one of the glyph bitmaps from the font format is selected and provided to a device driver associated with the display device. Thereafter, the physical pixels corresponding to the selected glyph bitmap are displayed on the display device to form the image of the selected character.

According to another aspect of the present invention, enhancements are provided to the manner in which the background mode is specified. The background mode determines whether an opaquing bounding box is drawn on the display device before drawing the characters. The present invention provides additional background mode values to facilitate antialiased textout on RGB devices. Specifically, the present invention provides for a new list of background mode values that instruct the device driver to do a blending of the glyphs into the background.

DETAILED DESCRIPTION

Figure 1:
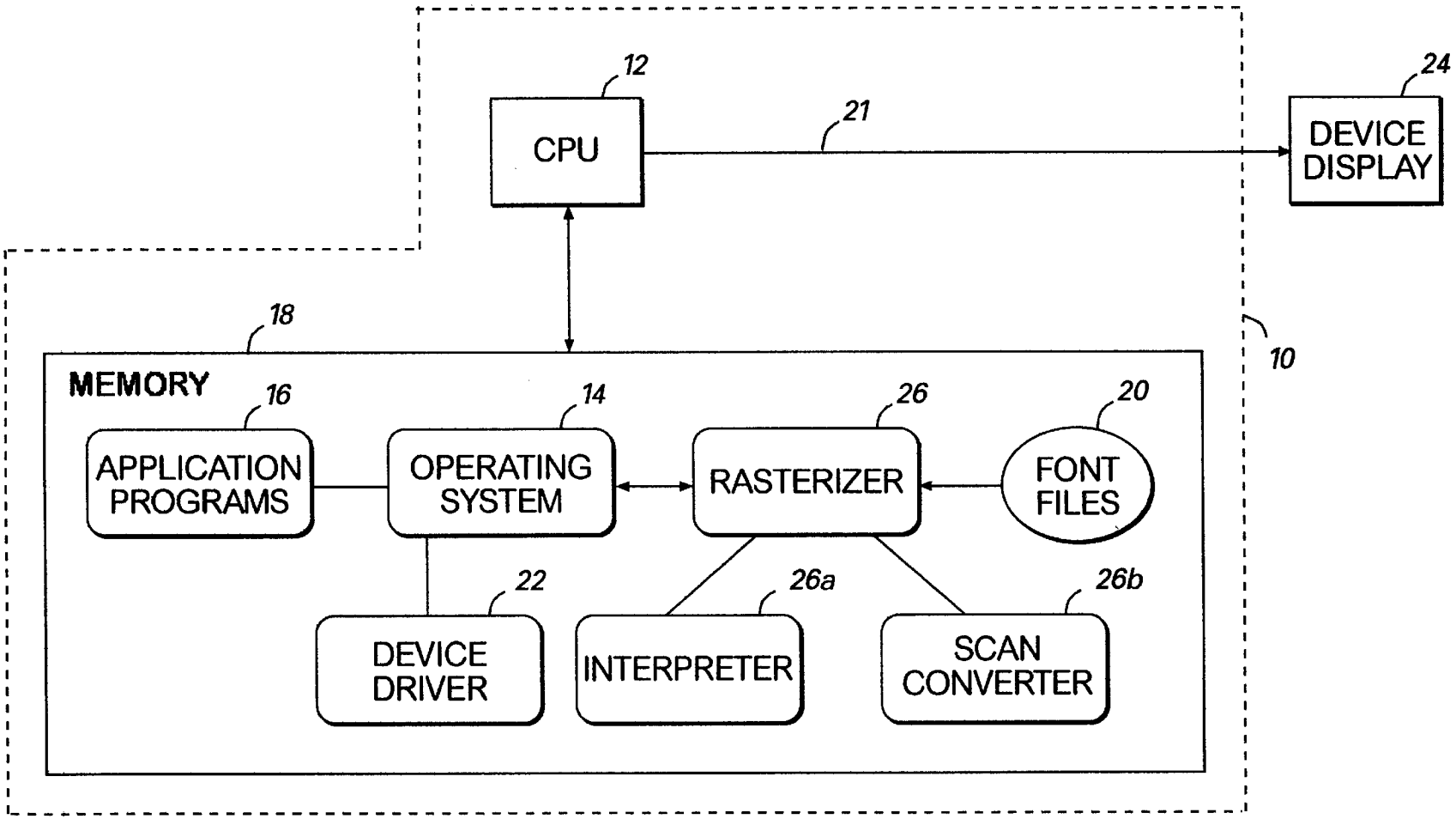
FIG. 1 is a block diagram of the preferred operating environment of the present invention.

Referring now to the drawing figures, in which like numerals indicate like elements or steps throughout the several views, the preferred embodiment of the present invention will be described. In general, the present invention provides a simplified font format that is better suited for the display of text-based characters on display devices than conventional font formats. The preferred font format is designed to pass only the bitmaps of the character itself rather than the surrounding white space as well, which consumes less storage space and allows for faster performance. Only the information needed to locate the glyph bitmaps and do font caching in the device driver is included in the font format, which represents a significant simplification over the current FONTINFO data structure.

In another aspect of the present invention, enhancements to the DRAWMODE data structure are provided in order to more fully utilize the improved font format described herein. More particularly, the present invention increases the number of background mode values that are passed to the device driver, which is useful for doing transparent antialiased textout on RGB devices. The new background mode values instruct the device driver to blend the glyphs into the background in predetermined blending levels.

1. System Architecture and Operation

FIG. 1 illustrates the preferred operating environment of the present invention. The present invention is based upon computer-implemented processes that can be embodied in one or more programs for a data processing system, such as the computer system 10 shown in FIG. 1, to carry out the methods and functions described herein. These computer-implemented processes operate upon electrical or other physical signals to generate the desired physical result, namely the illumination of physical pixels for a pixel-oriented display device.

Turning now to FIG. 1, the computer system 10 operates on font files 20 to support the display of text-based characters by connected display device 24. The computer system 10 includes a central processing unit (CPU) 12 which operates to execute an operating system 14 and application programs 16 desired by an operator of the computer system. The CPU 12 in the preferred embodiment, together with various peripheral support circuits (not shown), executes application programs written for the IBM PS/2, XT, AT or PC, or other compatible microcomputer system.

To simplify the representation of a general purpose computer system, conventional computer components, including computer resources such as direct memory access controller, interrupt controller, and I/O controllers, are not shown. However, it will be appreciated that CPU 12 is connected to conventional computer components via one or more system busses that support communications of control, address, and data signals between the CPU 12 and these standard computer components.

Font files 20 may comprise either "bitmapped fonts" or "outline fonts", such as True Type fonts. Bitmapped fonts comprise a set of characters in a particular size and style, in which each character is stored as a bitmap pixel pattern. Outline fonts, on the other hand, are stored as a set of mathematical outlines for drawing each of the characters in the character set. Thus, outline fonts are templates rather than actual patterns of dots and are scaled up or down to match a particular type size. The font files 20 for an outline font may also store hinting instructions, which are a set of routines that adjust the shape of the character outline for the requested font size and resolution to fit the appropriate boundaries of the pixel grid.

The operating system 14, font files 20 and application programs 16 can be stored within memory 18. The memory 18, which is connected to the CPU 12 via a bi-directional signal path, may be implemented as volatile memory, such as random access memory (RAM), or nonvolatile memory, such as a fixed disk drive, or a combination of both memory types. Although it is not shown in the drawing, it will be appreciated that a disk drive may also be connected to the CPU 12 so that data, such as the font files 20, can be transferred back and forth between the disk drive and the memory 18. For example, the operating system 14, font files 20 and application programs 16 can be stored in a permanent manner within nonvolatile memory such as a disk drive. Subsequent to the booting of the operating system 14, one or more of the required font files 20 or application programs 16 can be copied to the temporary memory mechanism of volatile memory.

The computer system 10 further comprises a communications link 21, which allows the computer system to communicate with other processing units, data storage devices, or other peripherals. Communications link 21 may comprise any of the common busses or interfaces which are well known in the art, such as ISA, EISA, MCA, PnPISA, PCI, SCSI and PCMCIA. In particular, it is contemplated that a display device 24 may be connected to the computer system 10 for the display of text-based characters. Display device 24 may comprise a raster display, printer, or any other pixel-oriented display device.

Display device 24 may require its own controlling software, or "device driver" 22. Device driver 22 comprises software components that permit the CPU 12 to communicate with display device 24. Device driver 22 may consist of a single-layer or of multiple layers of drivers, in which case higher-level drivers associated with a specific application program perform a data translation function and lower-level drivers send the data to the display device 24.

Although the disclosed embodiment shows the font files 20 and device driver 22 as being directly accessible by the CPU 12, it will be appreciated that the font files 20 and device driver 22 also can be stored within a memory storage area (not shown) associated with the display device 24.

Computer system 10 may also include a rasterizer 26, which includes an interpreter 26*a* and a scan converter 26*b*, for producing bitmaps from the character outlines of font files 20. The operating system 14 or an application program 16 will invoke the rasterizer 26 when the font to be displayed is an outline font such as TrueType, or when the font to be displayed is modified and therefore requires a new bitmap. The interpreter 26*a* reads the font description of the character outline supplied by the font file 20. In addition, the interpreter 26*a* receives information to support the scaling of the character outline, including the point size of the character to be displayed and the predetermined resolution of the selected display device 24.

The character outlines are then scan converted by the scan converter 26*b* in a conventional manner to produce a bitmap image that can be rendered on the selected display device 24. The character bitmaps produced by the scan converter 26*b* define the pixels to be activated for displaying images of the characters on the selected display device 24. The character bitmaps are typically cached within either volatile or non-volatile memory of the computer system 10 or the display device 24 for future use.

It will be appreciated that the disclosed rasterizer 26 is utilized only if an outline font such as TrueType is requested. Because each character in a bitmapped font is stored as a unique bitmap, the rasterizer 26 is generally not invoked if a bitmapped font is requested.

Figure 2:
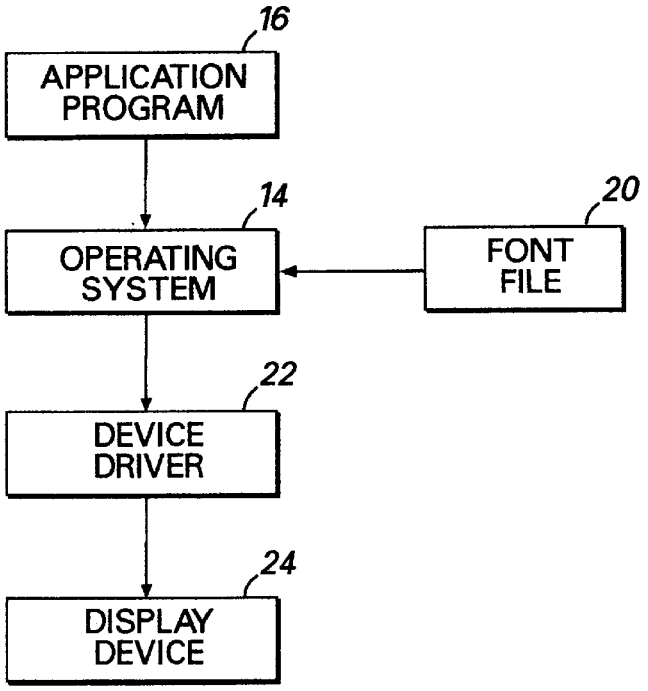
FIG. 2 is a block diagram illustrating the general procedure for the display of text-based characters in the preferred embodiment.

Turning now to FIG. 2, the general procedure for the display of text-based characters in the preferred embodiment will now be described. Referring to FIGS. 1 and 2, an application program 16 will, in general, call the operating system 14 to do a "TextOut" function to write a character string to a display device 24, specifying a particular font file 20. The operating system 14 will load the requested font file 20 and device driver 22 into memory 18.

The device driver 22 will specify certain information relating to the display of the character string, such as the preferred font format and glyph format. The preferred font format and glyph formats will be more fully described herein.

Still referring to FIGS. 1 and 2, when an application program 16 chooses a bitmapped font, the operating system 14 loads the requested font file 20 into memory 18. The font file 20 is converted from the FONTINFO data structure into the preferred font format as described herein. In the preferred embodiment, only the bitmap of the character itself (the "black box") is passed to the device driver 22 and cached into memory 18. This is in contrast to the current FONTINFO data structure, which passes the bitmap of the entire bounding box, including the unnecessary white space surrounding the character. By passing the bitmap of the black box only, the present invention saves memory space and provides for faster performance than previous font formats.

If, on the other hand, an outline font such as a TrueType font is chosen, the process is much the same, except that the rasterizer 26 is invoked to produce the bitmap from the character outline. The bitmap is then reformatted into the font format that the device driver 22 requested and cached in memory 18.

Next, the operating system 14 will call a function called "ExtTextOut", which writes text strings by converting characters in a given string into raster, vector or outline glyphs and copying the glyphs to the given display device 24 or bitmap. In general, the operating system 14 will call the ExtTextOut function whenever an application program 16 calls a function that draws text or computes text widths. Depending on the value of its parameters, ExtTextOut also computes the boundaries of the bounding rectangle of the displayed string, clips the text to fit a given clipping rectangle, fills a given rectangle with the specified background color before copying glyphs, and overrides the default spacing of the glyphs using values specified in an array of character widths.

The conventional ExtTextOut function has been modified in order to more fully utilize the benefits provided by the improved font format described herein. The modified ExtTextOut function for the preferred embodiment will be described in greater detail below.

2. Preferred Font Format

With that preface, the preferred embodiment for the improved font format will now be described. In general, the improved font format of the preferred embodiment is better suited for the display of text-based characters on display devices than conventional font formats such as the FONTINFO data structure for the "WINDOWS" operating system. Unlike previous font formats, the preferred font format is designed to pass only the bitmaps of the character itself rather than the surrounding white space as well. This allows for faster performance, while consuming far less storage space. Furthermore, unlike previous font formats, the header in the preferred font format is a collection of bitmaps, not a character string, and is thus not language dependent. Because only the information needed to locate the glyph bitmaps and do font caching in the device driver is included, the header of the preferred font format is much simpler and less complex than the current FONTINFO data structure.

Figure 3:
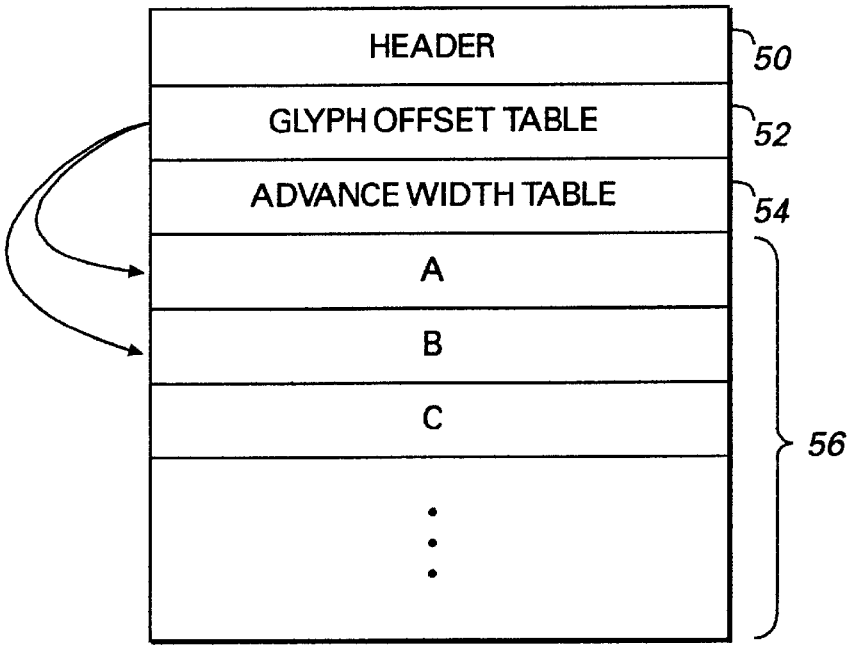
FIG. 3 is a memory image of the preferred font format.

FIG. 3 illustrates a memory image of the preferred font format. Referring to FIG. 3, the preferred font format begins with a header 50, which includes global information about the font. The header 50 of the preferred font format, which is considerably simpler than the header of previous font formats, will be described in detail below.

Following the header 50 is a movable "glyph offset table" 52, which is an offset from the beginning of the font segment to an array which points to the glyph bitmaps 56. The glyph offset table 52 will be described in greater detail below.

Still referring to FIG. 3, a movable "advance width table" 54 follows the glyph offset table 52. The advance width table 54 is an offset from the beginning of the font segment to an array of 16-bit values that specify the distance from one glyph's origin to the next. The advance width table 54 will be described in greater detail below.

Following the advance width table 54 are the actual glyph bitmaps 56 for each character in the font.

One example of the preferred font format header 50 written in the C programming language is shown in Table 1.

TABLE 1

```
struct _NewFontSeq
  {
      WORD nfVersion;          // Version of the font header
      WORD nfFormat;           // Format flags for font
      WORD nfNumGlyphs;        // Number of glyphs in the font
      DWORD nfGlyphOffset;     // Offset to array of glyph pointers
      DWORD nfAWTable;         // Offset to array of advance widths
      WORD nfHeight;           // Windows font height
      WORD nfAscent;           // Distance from top of font to
                                  baseline
      DWORD nfUniqueID;        // Unique value that identifies the
                                  font
  }   NewFontSeq;
```

Referring to Table 1 and FIGS. 1–3, the fields of the preferred font format header 50 will be described.

nfVersion: Indicates the version of the font header.

nfFormat: Contains several flags indicating the format on the information in this font. In the preferred embodiment, the flags defined are shown in Table 2:

TABLE 2

| | |
|---|---|
| NF_BYTE_PACKED | 0x0001 |
| NF_BIT_PACKED | 0x0002 |
| NF_FROM_BMP | 0x0040 |
| NF_LARGE | 0x0080 |

Referring to FIGS. 1–3 and Table 2, the first two flags indicate the format of the glyph bitmaps 56, which will be described in detail below. The NF_FROM_BMP flag tells the device driver 22 that the font was derived from a bitmapped font and that several assumptions can be made, for example, that the format is always small (i.e., less than 64 k in size), that the glyphs do not overlap if there is no spacing array provided that tells the operating system 14 to move to a particular point, and that the glyph indexes from the operating system are always BYTEs. As is well known in the art, a BYTE is a data type describing an 8-bit unsigned integer, where "unsigned" indicates that the variable will be used only to contain positive values.

In the preferred embodiment, the nfFormat field also includes an NF_LARGE flag that relates to the glyph offset table 52, which is an offset from the beginning of the font segment to an array which points to the glyph bitmaps 56. The glyph offset table 52 will be described in greater detail below. Specifically, the NF_LARGE flag tells the device driver 22 that the glyph offset table 52 is a DWORD array instead of an WORD array and that the glyph header is stored in large format. As is well known to those skilled in the art, WORD is a data type describing an unsigned 16-bit integer and DWORD is a data type describing an unsigned 32-bit integer. Thus, the NF_LARGE flag indicates whether the format is large (i.e., greater than 64 k in size) or small (i.e., less than 64 k in size).

It will be appreciated that the presence of the NF_LARGE flag represents a significant improvement over the old font format, which always assumed that the font requested was large, or greater than 64 k in size. Because the vast majority of fonts are much smaller than 64 k, the preferred embodiment conserves storage space and improves performance speed by allowing for a WORD offset to be used to point to the glyph bitmaps 56. If it is detected that the character is going to exceed the 64 k limit, the font will be dynamically converted to a large format by setting the NF_LARGE flag, in which case a DWORD array is used to point to the glyph bitmaps 56.

nfNumGlyphs: Referring back to Table 1 and FIGS. 1—3, the nfNumGlyphs field indicates the total number of glyphs in the font. This field is used to facilitate font caching in the device driver 22 by allowing it to determine the amount of memory space to allocate.

nfGlyphOffset: Specifies the glyph offset table 52, which is an offset, or pointer, from the beginning of the font segment to an array of WORDS (or DWORDs if NF_LARGE is set) which point to the glyph bitmaps 56. Because the glyph offset table 52 is accessed by a pointer, the glyph offset table 52 is considered movable. That is, by changing the pointer, an entirely new set of glyphs can be displayed. Thus, unlike the previous font formats, in which the character offset table was in a fixed position, the preferred font format may be reallocated and extended by adding additional tables.

nfAWTable: Specifies the advance width table 54, which is an offset, or pointer, from the beginning of the font segment to an array of signed 16-bit values that specify the distance from one glyph's origin to the next. Like the glyph offset table 52, the advance width table 54 is accessed by a pointer, and is therefore movable. It will be appreciated that the character offset table in the old font format, which is at a fixed location, has been replaced in the present invention by two separate arrays that are movable, the glyph offset table 52 and the advance width table 54.

nfHeight: Specifies the height of the font, which may be used by caching device drivers 22 that want to do self-opaquing.

nfAscent: Specifies the ascent of the font, which may be used by caching device drivers 22 to move from the baseline of the font to the top of the font's opaquing rectangle.

nfUniqueID: Specifies a single DWORD that uniquely identifies the font and can be used by caching device drivers 22 to keep track of the fonts in its cache.

The font format of the preferred embodiment provides a number of improvements over the existing FONTINFO data structure. First, the header 50 in the preferred font format is a collection of bitmaps, not a character string, thereby rendering much of the fields in the old header, such as vertical resolution, horizontal resolution, italic, and underline, unnecessary. Only the information needed to locate the glyph bitmaps 56 and do font caching in the device driver 22 is available in the font file 20 as reformatted by the operating system 14. All other information is kept hidden in the operating system 14, which allows for the header 50 in the preferred font format to be much simpler than in the old format. Accordingly, the header 50 in the preferred font format contains only eight public members or fields, whereas the header in the previous FONTINFO data structure includes approximately 30 public members or fields.

3. Glyph Formats

Figure 4A:
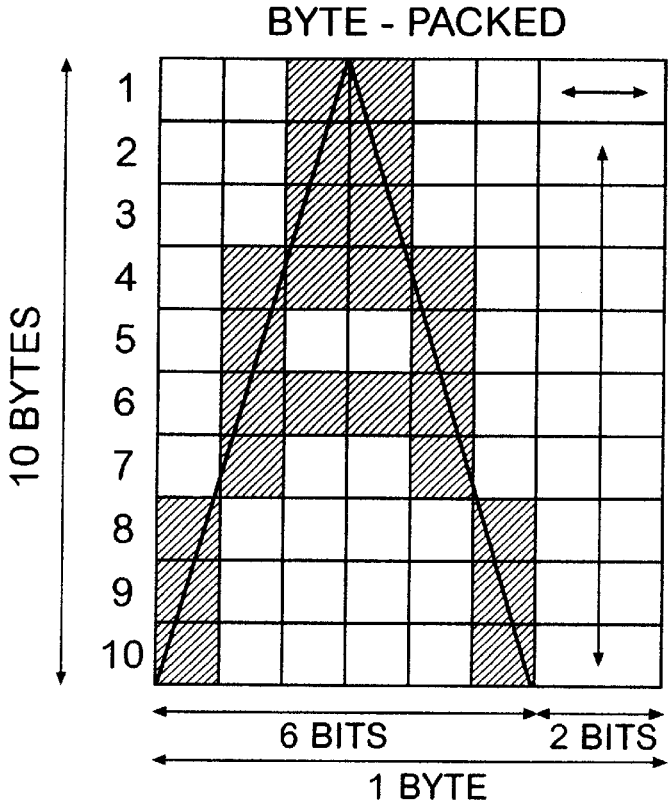
FIG. 4A is an illustration of a byte-packed glyph (the letter "A") that is six pixels wide and 10 pixels tall.

In the preferred embodiment, there are two types of glyph formats that may be specified by the device driver 22: "bit-packed" and "byte-packed" glyphs. Byte-packed glyphs are stored in rows, where each row is padded out to a byte boundary. FIG. 4A illustrates one example of a byte-packed glyph (the letter "A") that is six pixels wide and 10 pixels tall. As can be seen in the illustration, each row of the glyph bitmap is padded out to a byte boundary, meaning that only the first 6 bits of each byte is actually used. Because of the unused 2 bits of each byte, the glyph would require a full 10 bytes [int((6+7)/8)*10] of storage space.

Figure 4B:
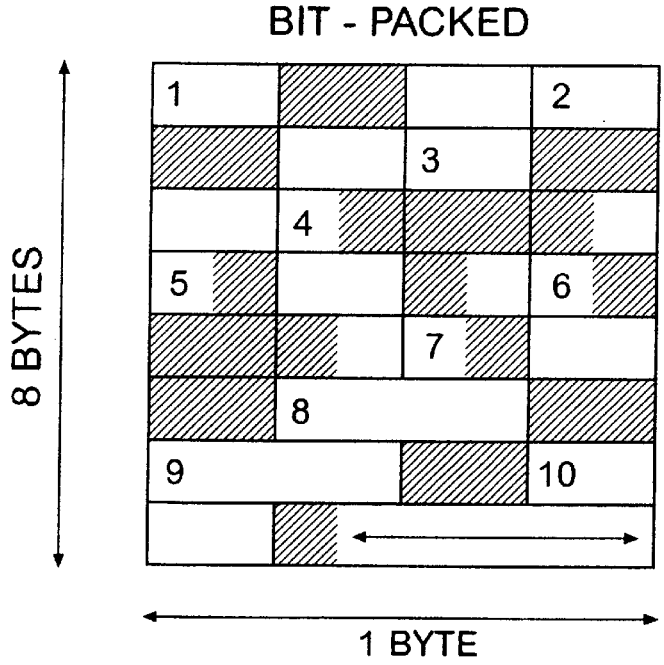
FIG. 4B is an illustration of the same 6×10 glyph (the letter "A") shown in FIG. 4A that is stored as a bit-packed glyph.

Bit-packed glyphs, on the other hand, are stored in rows with no padding. FIG. 4B illustrates the same 6×10 glyph (the letter "A") that is stored as a bit-packed glyph. In this case, all eight bits of each byte are used, leaving no unused bits. Thus, the same 6×10 glyph would only require eight bytes [int((6*10+7)/8)] of storage space.

Those skilled in the art will recognize that both the byte-packed and bit-packed glyph formats provide substantial memory savings over conventional formats, because neither bitmap includes the surrounding white space around the "black box".

Examples of the byte-packed and bit-packed glyph formats written in the C programming language are shown in Table 3.

TABLE 3

```
struct _BYTEPACKEDGLYPH
{
GLYPHHEADER header;
BYTE Bits [ ];                  // Byte-packed glyph bitmap
} BYTEPACKEDGLYPH;
struct _BITPACKEDGLYPH
{
GLYPHHEADER Header;             // Glyph information
WORD NumBits;       ;           // # of bits in glyph
                                (width * height)
BYTE Bits[ ]                    // Bit-packed glyph bitmap
} BITPACKEDGLYPH;
```

Referring to Table 3, the header field in both the byte-packed glyph format and the bit-packed glyph format contains certain information about the glyph and is shown and described with regard to Table 4. The NumBits field in the bit-packed glyph format is the number of bits in the glyph, namely its width times its height. By precomputing the number of bits in the glyph, the device driver 22 can quickly determine how many bytes of glyph data are present.

In the preferred embodiment, the bitmap in both the byte-packed glyph format and the bit-packed glyph format is preceded by a header of the format shown in Table 4.

TABLE 4

```
struct _GLYPHHEADER
{
SBYTE OrgX;
SBYTE OrgY;
BYTE Width
BYTE Height;
} GLYPHHEADER;
```

Referring to Table 4 and FIGS. 1–2, those skilled in the art will recognize that SBYTE is a data type describing a signed 8-bit integer. OrgX is the distance from the glyph origin to the left edge of the glyph's black box, and orgY is the distance from the glyph origin to the top of the glyph's black box. Width and Height are the width and height of the glyph's black box, respectively. Thus, the glyph header contains information that the device driver 22 uses to draw the glyph on the display device 24, namely how to move from the glyph's origin to the upper left corner of the glyph's black box.

4. Enhancements to ExtTextOut Function

According to another aspect of the present invention, the ExtTextOut function for the "WINDOWS" operating system has been modified in order to more fully utilize the benefits provided by the improved font format disclosed herein. Although the ExtTextOut function is a well known and well documented program, it will be useful to first briefly describe it in order to more clearly understand the modifications and enhancements provided herein.

The conventional ExtTextOut function is in the form:

DWORD ExtTextOut(*lpDestDev, wDestXOrg, wDestYOrg, lpClipRect, lpString, wCount, lpFontInfo, lpDrawMode, lpTextXForm, lpCharWidths, lpOpaqueRect, wOptions*).

The parameters of the conventional ExtTextOut function are defined as follows:

lpDestDev points to a PDEVICE or PBITMAP data structure specifying the device or bitmap to receive the text output. The PBITMAP data structure specifies the dimensions, attributes, and bits of a physical bitmap and is described in detail on pages 504–506 of the "Device Driver Adaptation Guide" for the "WINDOWS" operating system. The PDEVICE data structure contains information that a graphics driver uses to identify a device and the current state of the device and is described in detail on page 507 of the "Device Driver Adaptation Guide".

wDestXOrg specifies the x-coordinate (in device units) of the starting point for the character string to be displayed.

wDestYOrg specifies the y-coordinate (in device units) of the starting point for the character string to be displayed. ExtTextOut places the upper-left corner of the string at the point defined by the DestYOrg parameter, meaning that the characters in the string appear below and to the right of the starting point.

lpClipRect points to a RECT data structure specifying the clipping rectangle. The RECT data structure contains the coordinates of the top-left and bottom-right corners of a rectangle and is described in detail on page 508 of the "Device Driver Adaptation Guide" for the "WINDOWS" operating system. ExtTextOut clips text to the rectangle specified by lpClipRect, or to the intersection of lpClipRect and lpOpaqueRect if wOptions specifies ETO_CLIPPED. Only pixels within the rectangle are drawn. Pixels that have the same x-coordinate as the rectangle's right edge, or the same y-coordinate as the rectangle's bottom edge are not in the rectangle. For example, no pixels are drawn if the clipping rectangle is empty (zero width and height), and only pixel is drawn if it has a width and height of 1.

lpString points to an array of 8-bit character codes specifying the characters to display.

wCount specifies which action to carry out. If the value of wCount is negative, the x and y extents of the smallest rectangle that completely encloses the displayed string is computed, but no output is generated. In this case, the absolute value of wCount specifies the number of characters in the string. The function uses the current font, text justification, and other factors to compute the bounding rectangle, but does not apply the clipping rectangle. If the value of wCount is zero, the function fills the rectangle specified by lpOpaqueRect but only if wOptions is ETO_OPAQUE. In this case, the function does not generate text output. Finally, if the value of wCount is positive, the function draws the characters in the string. wCount specifies the number of characters to draw. The function uses the current font, text justification, escapement, rotation, and other factors to draw the characters, and it applies the clipping and opaque rectangles if specified.

lpFontInfo points to a FONTINFO data structure specifying the physical font to use. The FONTINFO data structure may be immediately followed by a character offset table and by font bitmap or vector information. The FONTINFO data structure is described in detail on pages 475–484 of the "Device Driver Adaptation Guide" for the "WINDOWS" operating system.

lpDrawMode points to a DRAWMODE data structure specifying the current text color, background mode, background color, text justification, and character spacing. The background mode determines whether ExtTextOut draws an opaquing bounding box before drawing the characters. The background color determines what color that box must be. The text color determines the color of the text in the box. The DRAWMODE data structure is described in detail on pages 469–471 of the "Device Driver Adaptation Guide" for the "WINDOWS" operating system.

lpTextXForm points to a TEXTXFORM data structure specifying additional information about the appearance of the characters when drawn. The ExtTextOut function checks the TEXTXFORM data structure to determine what additional actions are required to generate the desired text from the specified physical font. The TEXTXFORM data structure is described in detail on pages 512–514 of the "Device Drive Adaptation Guide" for the "WINDOWS" operating system. ExtTextOut uses the lpTextXForm parameter only if the device supports the additional text transformation capabilities. For example, if lpTextXForm specifies a point size different from the one specified by lpFontInfo, ExtTextOut should ignore the lpTextXForm point size unless the function can size characters.

lpCharWidths points to an array of character widths. If this parameter is not NULL, each element in the array is the advance width (in device units) of the corresponding character in the string. The function uses these widths (instead of the default character widths) to compute the position of the next character in the string. There must be one advance width for each character in the string.

lpOpaqueRect points to a RECT data structure specifying the opaquing rectangle.

wOptions specifies which action to carry out. It can be a combination of the following two values:

(1) ETO_OPAQUE, which fills the rectangle specified by the lpOpaqueRect parameter (and clipped to the lpClipRect parameter) with the background color specified by the lpDrawMode parameter). The function fills the rectangle regardless of whether lpDrawMode specifies opaque or transparent background mode.

(2) ETO_CLIPPED, which creates a new clipping rectangle by intersecting the rectangles specified by lpOpaqueRect and lpClipRect.

Referring to FIGS. 1 and 2, the modifications and enhancements to the above-described ExtTextOut function will now be discussed. The present invention greatly simplifies the ExtTextOut function to remove code in the device driver 22. According to the preferred embodiment, all of the rectangles in the lpOpaqueRect list are drawn in the selected background color (lpDrawMode→bkColor), then the text is drawn transparently on top in the selected text color (lpDrawMode→TextColor). All output is clipped to the clipping rectangle (lpClipRect), thus eliminating the need for the ETO_OPAQUE and ETO_CLIPPED flags in the preferred format TextOuts.

Furthermore, in the preferred embodiment, the wDestXOrg and wDestYOrg parameters are modified to point to the origin of the first glyph, not the upper left corner of the text bounding box as in the conventional ExtTextOut function. The lpString parameter points to an array of glyph indexes, not character codes. As described above, glyph indexes are simple indexes in the nfGlyphOffset and nfAWTable arrays and are not language specific. In the conventional ExtTextOut function, the lpString parameter points to character codes, which required arithmetic to compute the index into the glyph offset and advance width arrays. Thus, by using glyph indexes, the present invention allows the same device driver 22 to be used for all languages. A flag in the wOptions parameter indicates whether the glyph index array is a BYTE array or a WORD array.

Still referring to FIGS. 1 and 2, the modified ExtTextOut function also allows all special spacing information to be computed in the operating system 14 and given to the device driver 22 in the lpDx array parameter. The lpDx array parameter is a pointer to an array of integers that is wCount long. Thus the device driver 22 is not required to process the charExtra and DDA fields in the DRAWMODE data structure to determine character placement. If no special spacing is needed, the lpDx parameter will be NULL, indicating to the device driver 22 that it should use the nfAWTable array to move to the next glyph origin.

In addition, in the preferred embodiment the lpOpaqueRect points to a NULL terminated list of rectangles. The device driver 22 will preferably opaque all of the rectangles given in this list if lpOpaqueRect is non-NULL. The text background rectangle is included in this list if the text is drawn in opaque mode.

5. DRAWMODE Enhancements

According to another aspect of the present invention, the DRAWMODE data structure has been enhanced in order to more fully utilize the improved font format described herein. The DRAWMODE data structure specifies the current text color, background mode, background color, text justification and character spacing. The background mode determines whether the ExtTextOut function draws an opaquing bounding box before drawing the characters. The background mode can be set to either OPAQUE, which means that the background color is used to fill in the area between the character strokes, or TRANSPARENT, in which case the area between the character strokes is not colored. The background color determines what color the opaquing bounding box must be, while the text color determines the color of the text in the bounding box.

In the preferred embodiment, the number of background mode values in the DRAWMODE data structure that are passed to the ExtTextOut device driver has been increased. Prior the present invention, the background mode was used only to describe what to do when a glyph bit was "0", i.e., whether to fill that pixel with the background color (OPAQUE) or leave it alone (TRANSPARENT). The present invention expands the background mode to include several new font format background mode values for doing transparent antialiased textout on RGB devices. The new list of background mode values are shown in Table 5.

TABLE 5

| |
|---|
| BKMODE_TRANSPARENT |
| BKMODE_OPAQUE |
| BKMODE_LEVEL1 |
| BKMODE_LEVEL2 |
| BKMODE_LEVEL3 |

Referring to Table 5 and FIGS. 1–2, the BKMODE_TRANSPARENT and BKMODE_OPAQUE values are the same as the old TRANSPARENT and OPAQUE values, respectively. The new background mode values are the BKMODE_LEVELn values. The "leveln" values instruct the device driver 22 to do a blend of the glyphs into the background. In the preferred embodiment, the levels of blending are 25%, 50%, or 75%. For "level 1" antialiasing, a "1" in the glyph bitmap means that the device driver 22 should do a 25% blend from the current pixel color to the lpDrawMode→TextColor. For "level 2" antialiasing, the device driver 22 should do a 50% blend from the current pixel color into the background. For "level 3" antialiasing, the device driver 22 should do a 75% blend from the current pixel color to the lpDrawMode→TextColor. It will be appreciated that values other than 25%, 50% and 75% could also be selected.

In summary, the present invention provides an improved font format that is simpler and better suited for the display of text-based characters on display devices than conventional font formats. The preferred font format is designed to pass only the bitmaps of the character itself rather than the surrounding white space as well, which consumes less storage space and allows for faster performance. Because only the information needed to locate the glyph bitmaps and do font caching in the device driver is included, the preferred font format is considerably simpler and less complex than the current FONTINFO data structure.

Furthermore, the preferred embodiment includes enhancements to the DRAWMODE data structure in the form of an increased number of background mode values that are passed to the device driver. The new background mode values instruct the device driver to blend the glyphs into the background in predetermined blending levels, rather than only providing for the background color to be fully TRANSPARENT or fully OPAQUE. These enhancements are useful for doing transparent antialiased textout on RGB devices.

The present invention has been described in relation to particular embodiments which are intended in all respects to be illustrative rather than restrictive. Alternative embodiments will become apparent to those skilled in the art to which the present invention pertains without departing from its spirit and scope. Accordingly, the scope of the present invention is defined by the appended claims rather than the foregoing discussion.

What is claimed is:

1. A method for displaying glyphs on a display device, wherein each glyph has an associated glyph bitmap, comprising the steps of:

(a) formatting each associated glyph bitmap in a predetermined glyph format containing only glyph information for displaying the corresponding glyph;

(b) maintaining an offset to a movable array of glyph pointers, where each glyph pointer points to a set of glyph bitmaps among a plurality of sets of glyph bitmaps;

(c) maintaining an offset to a movable array of value pointers, where each value pointer points to a set of values that specify the distance between glyphs in the set of glyph bitmaps, where the set of glyph bitmaps corresponds to the set of values;

(d) storing each associated glyph bitmap in the predetermined glyph format;

(e) providing one of the sets of glyph bitmaps and the corresponding set of values;

(f) providing at least one glyph bitmap from the provided set of glyph bitmaps to a device driver associated with the display device; and (g) displaying the glyph associated with the provided one of the glyph bitmaps on the display device.

2. The method of claim 1, wherein the glyph information comprises:

the distance from an origin of the corresponding glyph to the left edge of a black box of the glyph, where the black box of the glyph contains only the glyph and no surrounding white space;

the distance from the origin of the corresponding glyph to the top of the black box of the glyph;

the width of the black box of the glyph; and the height of the black box of the glyph.

3. The method of claim 1, wherein for each set of glyph bitmaps, further comprising the steps of:

maintaining a first field including a plurality of flags indicating one of a plurality of predetermined glyph formats for the set of glyph bitmaps;

maintaining a second field including the number of glyphs in the set of glyph bitmaps;

maintaining a third field including the height of the set of glyph bitmaps;

maintaining a fourth field including the ascent of the set of glyph bitmaps; and maintaining a fifth field including a unique identification for the set of glyph bitmaps.

4. The method of claim 3, wherein said first field includes a first flag indicating a byte-packed glyph format and a second flag indicating a bit-packed glyph format.

5. The method of claim 4, wherein said first field further includes a third flag indicating whether the set of glyph bitmaps is stored as a small format or a large format.

6. The method of claim 5, further comprising the steps of:

detecting the size of the set of glyph bitmaps; and if the size of the set of glyph bitmaps exceeds a predetermined threshold, then setting the third flag to indicate that the set of glyph bitmaps is stored as a large format.

7. The method of claim 5, wherein said first field further includes a fourth flag indicating whether the set of glyph bitmaps was derived from a bitmapped font.

8. The method of claim 1, further comprising the steps of:

selecting the text color for the glyph to be displayed;

selecting the background color for the area surrounding the glyph;

selecting a blending level; and blending the text color into the background color according to the selected blending level.

9. The method of claim 8, wherein the blending level is selected from the group consisting of 25%, 50% and 75%.

10. The method of claim 2, wherein the step of providing at least one glyph bitmap from the provided set of glyph bitmaps includes providing only the black box of the corresponding glyph to the device driver.

11. The method of claim 4, wherein the byte-packed glyph format comprises storing the corresponding glyph in rows with padding to a byte boundary.

12. The method of claim 4, wherein the bit-packed glyph format comprises storing the corresponding glyph in rows with no padding such that all bits of each byte are occupied, thereby leaving no unused bits.

13. The method of claim 4, wherein the byte-packed glyph format and the bit-packed glyph format each include a black box containing only the corresponding glyph and no surrounding white space.

14. A system for displaying glyphs on a display device, wherein each glyph has an associated glyph bitmap, the system comprising:

a memory for storing each associated glyph bitmap in a predetermined glyph format;

a font file stored in the memory, the font file comprising:

a first record including the predetermined glyph format containing only glyph information for displaying the corresponding glyph, a second record including an offset to a movable array of glyph pointers, where each glyph pointer points to a set of glyph bitmaps among a plurality of sets of glyph bitmaps, a third record including an offset to a movable array of value pointers, where each value pointer points to a set of values that specify the distance between glyphs in the set of glyph bitmaps, where the set of glyph bitmaps corresponds to the set of values, and a fourth record including the plurality of sets of glyph bitmaps;

a device driver associated with the display device for receiving at least one glyph bitmap from a selected one of the plurality of sets of glyph bitmaps from the font file; and a display device for displaying the glyph associated with the received one of the glyph bitmaps.

15. The system of claim 14, wherein the glyph information comprises:

the distance from an origin of the glyph to the left edge of a black box of the glyph, where the black box of the glyph contains only the glyph and no surrounding white space;

the distance from the origin of the glyph to the top of the black box of the glyph;

the width of the black box of the glyph; and the height of the black box of the glyph.

16. The system of claim 14, wherein for each set of glyph bitmaps, the first record further comprises:

a first field including:

a first flag indicating a byte-packed glyph format, a second flag indicating a bit-packed glyph format, a third flag indicating whether the set of glyph bitmaps is stored as a small format or a large format, and a fourth flag indicating whether the set of glyph bitmaps was derived from a bitmapped font, a second field including the number of glyphs in the set of glyph bitmaps;

a third field including the height of the set of glyph bitmaps;

a fourth field including the ascent of the set of glyph bitmaps; and a fifth field including a unique identification for the set of glyph bitmaps.

17. The system of claim 14, further comprising a draw-mode record stored in the memory including:

the text color for the glyph to be displayed;

the background color for the area surrounding the glyph; and a blending level for blending the text color into the background color according to the selected blending level.

18. A computer-readable medium on which is stored a program module for displaying a plurality of glyphs of a font on a pixel-oriented display device, each glyph having an associated glyph bitmap corresponding to physical pixels for forming an image of the glyph on the display device, the program module comprising instructions which, when executed by said computer system, perform the steps of:

formatting each associated glyph bitmap including:

the distance from an origin of the glyph to the left edge of a black box of the glyph, where the black box of the glyph contains only the glyph and no surrounding white space, the distance from the origin of the glyph to the top of the black box of the glyph, the width of the black box of the glyph, and the height of the black box of the glyph;

maintaining a first record including font information;

maintaining a second record including an offset to a movable array of pointers for pointing to a selected one of the plurality of glyph bitmaps;

maintaining a third record including an offset to a movable array of values that specify the distance from the location of a first glyph to the location of a second glyph;

maintaining a fourth record including the plurality of glyph bitmaps;

providing the selected one of the plurality of glyph bitmaps to a device driver associated with the display device; and displaying the physical pixels corresponding to the selected glyph bitmap on the display device.

19. The computer-readable medium of claim 18, wherein said first record comprises:

a first field including:

a first flag indicating a byte-packed glyph format, a second flag indicating a bit-packed glyph format, a third flag indicating whether the set of glyph bitmaps is stored as a small format or a large format, and a fourth flag indicating whether the set of glyph bitmaps was derived from a bitmapped font;

a second field including the number of glyphs in the font;

a third field including the height of the font;

a fourth field including the ascent of the font; and a fifth field including a unique identification for the font.

20. The computer-readable medium of claim 19, wherein the byte-packed glyph format and the bit-packed glyph format each include a black box containing only the corresponding glyph and no surrounding white space.

* * * * *